US006230350B1

(12) United States Patent
Goldstein

(10) Patent No.: US 6,230,350 B1
(45) Date of Patent: May 15, 2001

(54) HEAD SUPPORT PAD WITH AIR ACCESS CONDUIT

(76) Inventor: Allen H. Goldstein, 24304 Marsh Landing Parkway, Ponte Vedra Beach, FL (US) 32082

( * ) Notice: Subject to any disclaimer, the term of this patent is extended or adjusted under 35 U.S.C. 154(b) by 0 days.

(21) Appl. No.: 09/395,454

(22) Filed: Aug. 4, 1998

Related U.S. Application Data

(63) Continuation-in-part of application No. 08/851,832, filed on May 5, 1997, now abandoned.

(51) Int. Cl.[7] ..... A47C 20/02
(52) U.S. Cl. ..... 5/638; 5/636
(58) Field of Search ..... 5/638, 636, 724, 5/652.1, 655, 945; D6/601

(56) References Cited

U.S. PATENT DOCUMENTS

D. 337,914 * 8/1993 McDonald ..... D6/601
D. 414,974 * 10/1999 Marrone et al. ..... D6/601
2,688,142 * 9/1954 Jensen ..... 5/638
5,269,035 * 12/1993 Hartunian ..... 5/638
5,697,113 * 12/1997 Shatz et al. ..... 5/655
5,960,494 * 10/1999 Gilliland et al. ..... 5/638

* cited by examiner

*Primary Examiner*—Lynne H. Browne
*Assistant Examiner*—Fredrick Conley
(74) *Attorney, Agent, or Firm*—Thomas C. Saitta

(57) ABSTRACT

A support pad or pillow for supporting the head in a face down, prone position, the pad having a face recess providing a breathing void and at least one air flow conduit extending from the face recess through the body of the support pad to the exterior to provide fresh ambient air to the face recess area, where the air flow conduit contains rigid support means to prevent the conduit from being compressed, restricted or closed by the weight of the user's head, and a filter to block particulate matter from entering the air flow conduit.

12 Claims, 3 Drawing Sheets

HEAD SUPPORT PAD WITH AIR ACCESS CONDUIT

This application is a continuation-in-part of U.S. patent application Ser. No. 08/851,832 filed May 5, 1997, now abandoned.

BACKGROUND OF THE INVENTION

The invention relates generally to the field of head or head and body support pads or pillows, and more particularly to such devices which provide a recess area for the face in the prone position. Even more particularly, the invention relates to such devices which further include air access means for improved air circulation and ease of breathing.

There are numerous circumstances where a person is either required or desires to lie face down in a prone position, such as for example during medical procedures on the back, during physical therapy or massage sessions, while sunbathing or while sleeping. Typical pads, pillows, supports and mattresses provide a generally planar upper support surface, meaning that the user must either arch his or her neck to raise the face from the support or turn his or her head to one side or the other to breathe. This arching or twisting of the head exerts undesirable forces on the spine, creating a situation of reduced comfort and possible harm to persons who sleep in the face down position. Likewise, in certain medical or therapy procedures it may be required to maintain the head in the face down position for extended periods of time.

Improved pads, pillows or mattresses have been developed to address this problem. The most common solution is to provide a recess or cut-out portion at or near the edge of the pad. The recess is usually sized such that the user's head is laterally supported with the face extending into the open void created by the recess. While the use of a recess or cut-out alone obviates the need to either arch or turn the face to breathe, it has been found that in many circumstances the free flow of air is overly restricted, making it difficult for the user to breathe after a period of time, since relatively little fresh air exchange can occur. This is especially true where the recess does not extend completely to the end of the support pad.

To address this particular problem, pads or pillows have been designed which incorporate additional air flow pathways for the main face recess. For example, U.S. Pat. No. 4,752,064 to Voss shows a head support having a generally T-shaped recess in the middle. Relatively thin lateral channels or troughs are cut into the surface and extend from the area of the recess adjacent the mouth and nose to the edges of the support pillow. Voss indicates that the channels may serve as airways, but the channels are thin and shallow in cross-section and primarily serve as passageway for the insertion of tubes or wires. U.S. Pat. No. Des. 337,914 to McDonald shows a pillow of similar construction which improves on the Voss design by providing more channels than Voss and by sizing the channels somewhat larger. McDonald likewise positions the channels on the outer surfaces of the pillow. The main problem with the constructions of Voss and McDonald is that the channels are easily restricted or blocked by towels, blankets, sheets or the like. In addition, because the support pad or pillow is by nature resilient and compressible, the weight of the user's head will cause deformation of the pillow out of the original passive configuration, resulting in restriction or closure of the ends or the bodies of the channels. Guarino, in U.S. Pat. No. 5,426,798, shows a support mattress where the recess for the face extends completely to the edge of the mattress. This design reduces the amount of head support, since the forehead area is no longer supported by any structure, but it does improve air flow to the user. However, because the user's nose and mouth are positioned adjacent the closed end of the recess, free air flow is still limited as there is only one ingress and egress point for air exchange, and that point is at a point beyond the top of the user's head.

It is an object of this invention to provide a head support pad which incorporates a recess for placement of the user's face when in the prone position, where the air flow into the recess is improved by the provision of lateral conduits tunnels within the body of the support pad, the tunnels extending to opposing side walls of the support pad. It is a further object to provide such a device where the tunnels are formed by rigid tubular members whereby the weight of the user's head will not alter the diameter of the tunnels. It is a further object to provide such a device where filter means are mounted on the external openings of the tunnels to remove dust or other particulates from the air drawn into the recess. It is a further object to provide such a device with an attached flap on the underside of the recess, whereby the flap can be positioned beneath the recess to provide a barrier layer between the user and the surface beneath the support pad. These and other objects are attained by the provision of a device as set forth below.

SUMMARY OF THE INVENTION

The invention is in general a support pad, pillow, mattress or like object for cushioning and supporting the head of a person lying face down in the prone position. Preferably the support pad extends sufficient length to provide cushioning and support for some or all of the user's torso or full body. The support pad may be constructed and composed of any of the known materials suitable and in commonplace use for constructing pads, pillows or mattresses, including covers retaining filler material or expanded polymer foam, spring and frame structures, and air-, liquid- or gel-filled bladder-like structures. The support pad may be relatively rigid or relatively compliant, and the upper surface is preferably slanted when the support pad is placed on a horizontal surface.

The support pad is provided with a breathing or air access recess which enables the person to position his or her face within the recess, with the recess preferably extending completely through the support pad from the upper surface to the lower surface. The recess preferably is formed as a slot or cut-out portion having an open end extending through the free end of the support pad, but the recess may also be in the form of an aperture enclosed on all lateral sides by the support pad. The overall configuration of the recess may be of any configuration suitable for providing peripheral support to the user's head when the face is placed in the recess, including square, rectangular, oval, circular, U-shaped, V-shaped, or T-shaped.

The support pad is provided with at least one and preferably a pair of air flow or breathing conduits or tunnels. The air flow conduits are positioned within the body of the support pad, not cut into the surface, such that any cross-section taken perpendicular to the air flow direction defines a complete, non-segmented perimeter. Preferably the air flow conduits are laterally disposed, linear pathways, circular in cross-section, which extend from the exterior side walls of the support pad to the recess side walls. The air flow conduits are provided with conduit support means comprising rigid members which prevent the conduit from collapsing under pressure, such as rigid tubes. The air flow conduits may be provided with filter means to remove particulates from the air passing through the conduits. A barrier flap member, preferably a sheet of cloth or plastic, may be secured to the underside of the support pad so as to be positionable beneath the face recess.

DETAILED DESCRIPTION OF THE INVENTION

With reference to the drawings, the invention will now be described in detail with regard for the best mode and the preferred embodiment. The invention is referred to herein as a support pad, and this nomenclature is intended to include any type of pad, pillow, mattress or the like with equivalent function. As used herein, the term inferior is used to refer to the direction or end of the support pad which is placed under the user's head and body, while the term superior is used to refer to the opposite direction or end of the support pad which extends above or away from the user's head.

Figure 1:
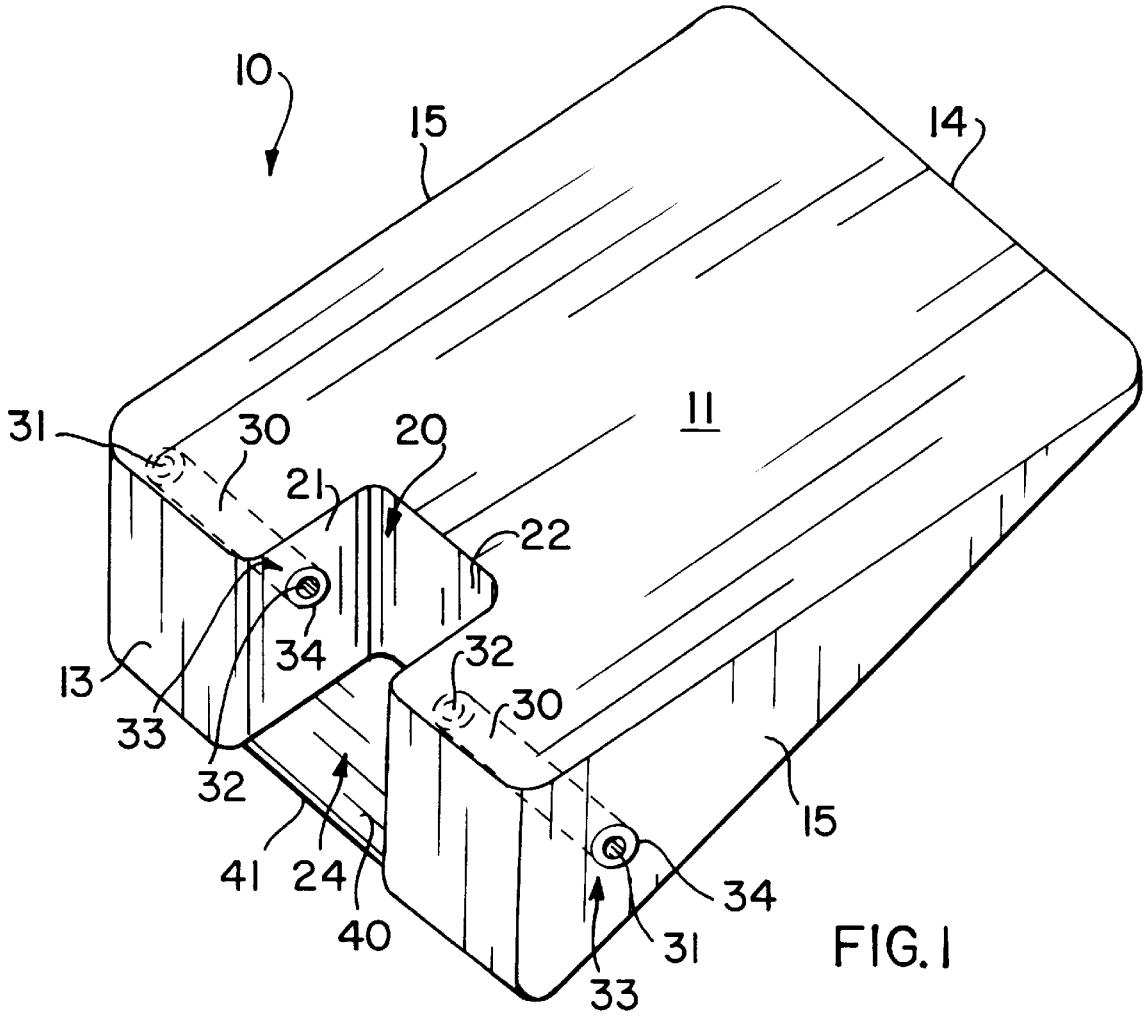
FIG. 1 is a perspective view of the invention, showing an open-ended face recess.
Figure 2:
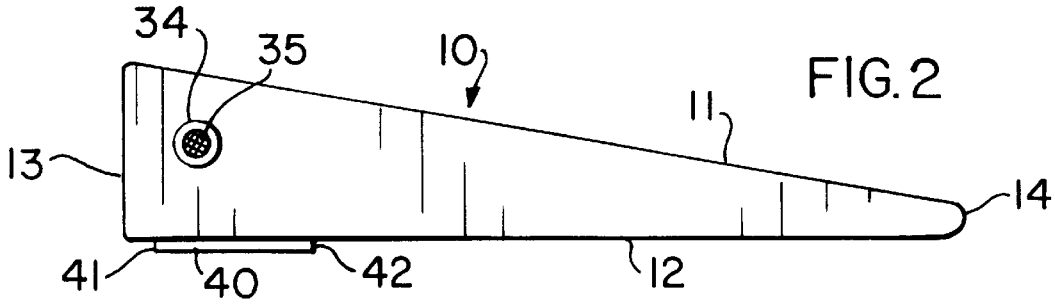
FIG. 2 is a side view of the invention of FIG. 1, also showing filter means positioned within the air flow conduit.
Figure 3:
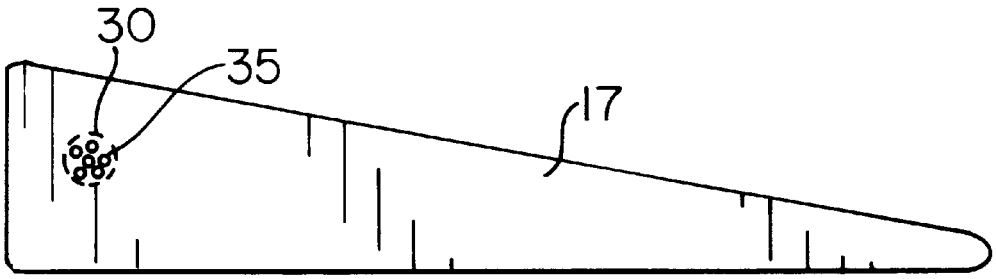
FIG. 3 is a side view of the invention showing a filter means positioned across the opening of the air flow conduit.
Figure 4:
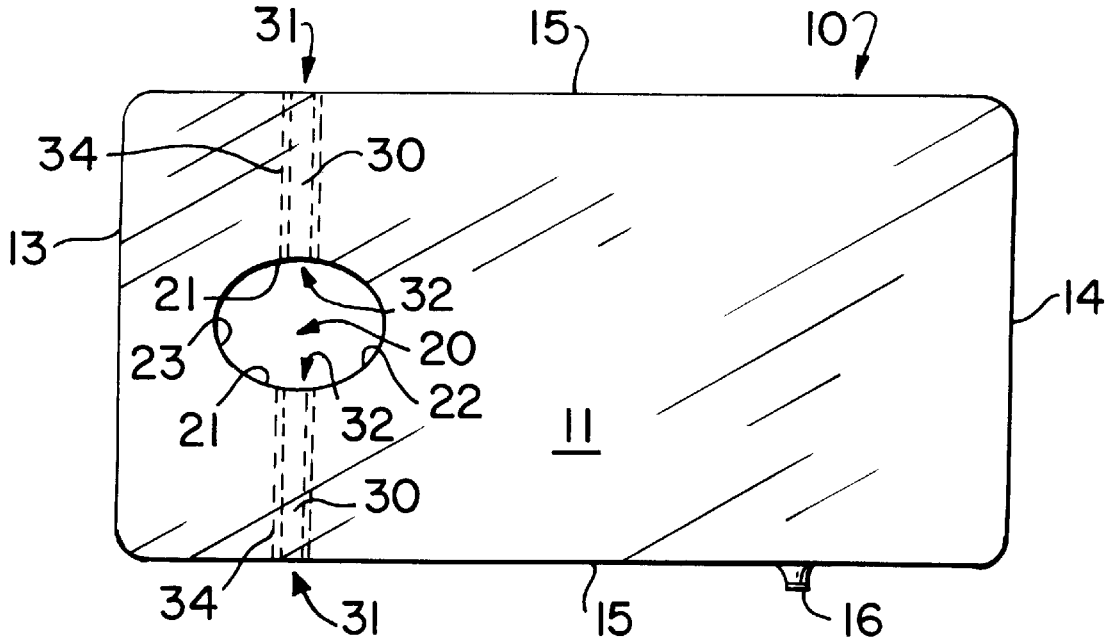
FIG. 4 is a perspective view of an alternative embodiment of the invention, showing an full perimeter face recess.
Figure 5:
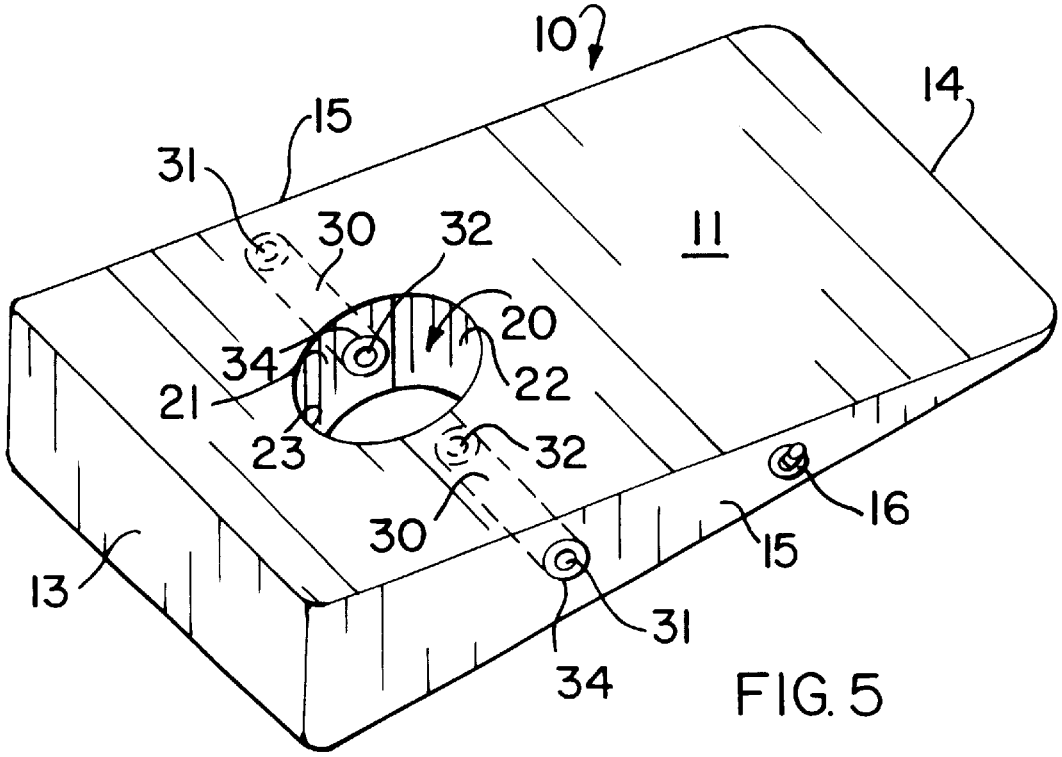
FIG. 5 is a top view of the invention of FIG. 3.

Referring to FIGS. 1 and 2, the invention is shown to be in general a support pad 10 comprising an upper support surface 11, a lower surface 12, a superior free end 13, an inferior end 14 and opposing side walls 15. The upper surface 11 and lower surface 12 as shown are generally rectangular in configuration, but different configurations are equally suitable. It is preferred that the inferior end 14 be shorter in height than the superior free end 13, such that the pad 10 is wedge-shaped when viewed from the side and the upper surface 11 is slanted when the lower surface 12 is horizontal, as this provides for a more comfortable transition for the user from a relatively planar table, bed or ground surface which lies beneath the pad 10. The support pad 10 is preferably sized to extend to the waist area of the user when the user's face is positioned in the face recess 20, but it may be longer or shorter, even to the point of only supporting the head of the user. The support pad 10 may be constructed in any of the commonly known techniques and of any of the commonly known materials used to construct pads, pillows, mattresses or the like. It is preferred that the support pad 10 be somewhat compressible and resilient for comfort. For example, the support pad 10 may have an outer surface of a relatively durable sheet material, such as cloth or plastic, permeable or impermeable, which encases a core of filler material, expanded polymer foam, air, water, gel or coiled springs, or combinations thereof. Where the support pad 10 is air- or water-filled, it is preferred that a filler plug 16 be provided, as shown in FIGS. 4 and 5, so that the filler material can be removed partially to adjust the size and support of the pad 20 or the device can be collapsed and rolled, folded or compacted for easy storage and transport. A washable or disposable outer cover 17 may be provided, as shown in FIG. 3.

The support pad 10 is provided with a face-receiving recess 20 adjacent the superior free end 13. The face recess 20 allows the face of the user to lie below the plane of the upper support surface 11 and provides an open void beneath the nose and mouth of the user for ease of breathing. The face recess 20 preferably extends completely through the body of the support pad 10 from the upper surface 11 to the lower surface 12, but the face recess 20 may be formed with a bottom member. The face recess 20 is configured in a shape which provides some peripheral support to the face or head of the user so that the user does not need to use the neck muscles to keep the head in a generally horizontal position. Support to the face or head may be across the forehead, down the sides, across the chin, or preferably a combination of at least two of these. The configuration of face recess 20 may be square, circular, rectangular, oval, triangular, T-shaped or any other suitable configuration. In the most preferred embodiment, as shown in FIG. 1, the face recess 20 has an open end 24 which extends through the superior free end 13 of the support pad 10, as this provides for greater air circulation into the face recess 20. The face recess 20 in FIG. 1 is shown as being generally rectangular, but other configurations such as square, semi-circular, semi-oval, T-shaped, V-shaped, U-shaped or the like are also possible. For a face recess 20 having an open end 24, the support for the user's face is provided by the lateral recess side walls 21 and/or the recess inferior wall 22. Alternatively, the support pad 10 may comprise a face recess 20 having a closed or non-segmented peripheral configuration having a recess inferior wall 22, recess side walls 21 and a recess superior wall 23, such as a full sided square, circle, rectangle, oval, as shown in FIGS. 4 and 5, triangle, T-shape, etc. Since supporting perimeter of the face recess 20 completely encircles the user's face, the face recess 20 must either extend completely through the lower surface 12 or additional air flow means must be provided.

As shown in all the figures, the support pad 10 is provided with at least one and preferably a pair of generally laterally extending internal air flow conduits or tunnels 30. Each internal air flow conduit 30 extends through the body or interior of the support pad 10 so as to be fully enclosed along the air flow path, such that a cross-section of the wall of the air flow conduit 30 taken perpendicular to the air flow path defines a continuous, non-segmented perimeter. Each air flow conduit 30 has an exterior opening 31 in one of the side walls 15 and a recess opening 32 in one of the recess side walls 21 so that the face recess 20 is in fluid communication with ambient air external to the support pad 10. The interior recess opening 32 is preferably positioned at a location adjacent the mouth and nose area of the user. In this manner when the user is face down on the support pad 10 and the face is cradled by the face recess 20, an ample supply of fresh air is available for breathing and recirculation to maintain comfortable temperatures within the face recess 20.

While the support pad 10 may be constructed in such a manner or with sufficiently rigid material whereby the air flow conduits 30 cannot be compressed under normally expected force, it is most preferred that additional conduit support means 33 be provided to prevent deformation, restriction or closure of the air flow conduits 30. Conduit support means 33 may be composed of any suitably strong and rigid material and may comprise different configurations or structure depending on the configuration of the air flow conduit 30, as long as the air flow is not significantly blocked or restricted by the conduit support means 33, but it is most preferred that the air flow conduit 30 be circular in cross-section and that conduit support means 34 comprise a tube member 34 made of plastic, metal or the like in sufficient thickness such that it is non-compressible under the forces normally expected to be encountered, which primarily will result solely from the weight of the user's head. Open-ended plastic tubing made of PVC and extending from the exterior opening 31 to the recess opening 32 has been found to be highly suitable for the purposes herein.

Figure 7:
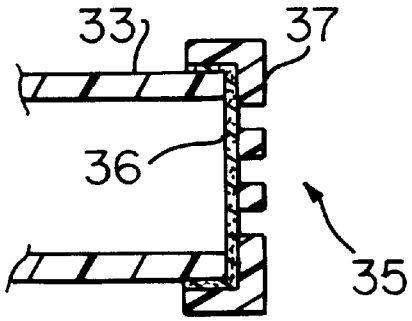
FIG. 7 is a partial view, shown in cross-section, of the filter means positioned on the end of the air flow conduit.
Figure 6:
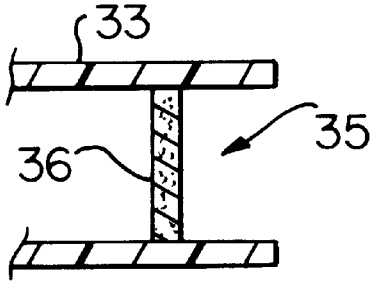
FIG. 6 is a partial view, shown in cross-section, of the filter means positioned internally within the air flow conduit.

Filter means 35 are preferably combined with said air flow conduits 30, preferably positioned across or within the exterior opening 31 of each air flow conduit 30 to filter unwanted particulates from the air being drawn into the face recess 20, as shown in FIGS. 2 and 3. In outdoor usage the filter means 35 will also prevent insects or wind-blown sand or debris from entering the air flow conduits 30. Filter means 35 may comprise any known filtering media 36 which is capable of blocking undesirable matter while allowing for relatively unrestricted air flow. For example, filter media 36 may comprise a screen, mesh, apertured plastic member, woven or fabric material, or a particulate or activated carbon filter material, positioned within the air flow conduit 30 or conduit support means 33, as shown in FIG. 6, or filter media 36 of similar type and construction may be positioned over the end of the exterior opening 31 of the air flow conduit 30 or conduit support means 33, such as by incorporating the filter media 36 into an apertured cap or plug member 37 which mates with the conduit support means 33, as shown in FIG. 7. In FIG. 3 the filter means 35 is shown as incorporated directly into an external cover 17 for the pad 10 so as to be positioned directly across the exterior opening 31. Where a fabric or woven material is used for the filter media 36, the material may be apertured to increase air flow or the filter media 36 may consist of a material chosen such that the spacing between the weaves or threads is sufficient to allow suitable air flow while simultaneously blocking particulate matter from entering the air flow conduits 30.

The support pad 10 may also be provided with a barrier flap member 40, as shown in FIGS. 1 and 2. For use especially when the support pad 10 is to be used on the ground or at the beach, the barrier flap 40 extends across the bottom of the face recess 20 to prevent the user from stirring up sand or debris while breathing. Preferably the barrier flap 40 has a free end 41 and a secured end 42, the secured end 42 being attached to the lower surface 12 of the support pad 10 by stitching, adhesive, melt sealing or like method such that the barrier flap 40 can be removed from beneath the face recess 20 when not needed, yet easily put into place by pulling the barrier flap free end 41 toward the superior free end 13 of the support pad 10 to cover the bottom of the face recess 20. Barrier flap 40 may be composed of any suitable sheet material, relatively thin, and flexible or rigid, such as plastic or cloth.

It is understood that certain equivalents and substitutions may be obvious to those skilled in the art, and the true scope and definition of the invention therefore is to be as set froth in the following claims.

I claim:

1. A support pad comprising:

(A) a generally planar upper support surface, a generally planar lower surface, pad side walls joining said upper support surface to said lower surface, an inferior end and a superior end, which in combination define a pad for supporting the torso and head of a user in the face-down, prone position wherein said inferior end is shorter than said superior end such that said support pad is generally wedge-shaped;

(B) a generally U-shaped face recess positioned in said upper support surface and extending through said pad through said lower surface, said recess comprising opposing recess side walls defining a breathing void in said pad and a recess open end extending through said superior end, said recess having a configuration to receive the face of a user while laterally supporting the user's head;

(C) a pair of internal air flow conduits positioned within said pad, one of said pair of air flow conduits having an exterior opening in one of said pad side walls and a recess opening in one of said recess side walls, and the other of said pair of air flow conduits having an exterior opening in the other of said pad side walls and a recess opening in the other of said recess side walls; and (D) filter means combined with said pair of internal air flow conduits to prevent particulate matter from entering said pair of air flow conduits.

2. The device of claim 1, where said at least one air flow conduit further comprises conduit support means which prevent deformation of said at least one air flow conduit.

3. The device of claim 2, where said conduit support means comprises a rigid tubular member.

4. The device of claim 1, further comprising a movable barrier flap member attached to said lower surface, said barrier flap being positionable across said face recess at said lower surface whereby said face recess may be blocked or exposed on said lower surface dependent on the position of said barrier flap relative to said face recess.

5. The device of claim 1, further comprising a filler plug such that said pad is fillable with a fluid which can be removed to collapse said pad.

6. The device of claim 1, where said filter means is positioned within said pair of air flow conduits.

7. The device of claim 1, where said filter means is positioned across said exterior openings of said pair of air flow conduits.

8. The device of claim 7, further comprising a cover positioned on said support pad, where said filter means is incorporated into said cover.

9. The device of claim 1, where said filter means comprises a fabric material.

10. The device of claim 9, where said fabric material is apertured.

11. The device of claim 1, where said filter means comprises a screen material.

12. The device of claim 1, where said filter means comprises an activated carbon material.

* * * * *